US006433556B1

(12) United States Patent
Smith

(10) Patent No.: US 6,433,556 B1
(45) Date of Patent: Aug. 13, 2002

(54) CIRCUIT FOR GENERATING A RAMP SIGNAL BETWEEN TWO TEMPERATURE POINTS OF OPERATION

(75) Inventor: Gregory J. Smith, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/655,892

(22) Filed: Sep. 6, 2000

(51) Int. Cl.[7] ..... G05F 3/26; G05F 3/24
(52) U.S. Cl. ..... 324/546; 327/513; 323/907
(58) Field of Search ..... 327/132, 138, 327/512, 513, 545, 546; 323/351, 907

(56) References Cited

U.S. PATENT DOCUMENTS 5,034,626 A * 7/1991 Pirez et al. ..... 327/542
5,604,427 A * 2/1997 Kimura ..... 323/313
5,818,294 A * 10/1998 Ashmore, Jr. ..... 327/543
5,994,945 A * 11/1999 Wu et al. ..... 327/378
6,078,208 A * 6/2000 Nolan et al. ..... 327/512
6,265,857 B1 * 7/2001 Demsky et al. ..... 323/907

* cited by examiner

*Primary Examiner*—Kenneth B. Wells
*Assistant Examiner*—Terry L. Englund

(57) ABSTRACT

A circuit generating a ramp signal between two temperature values includes two pairs of transistors in current/mirror configurations and a signal converter. The transistors and signal converter are constructed and connected such that below a first temperature value a first constant signal is outputted. Between the first temperature value and a second temperature value, an increasing or decreasing ramp signal is outputted. Above the second temperature value, a second constant signal is outputted. The temperature values between which the ramp signal operates and the rate of increase or decrease of the ramp signal are selectable.

20 Claims, 6 Drawing Sheets

CIRCUIT FOR GENERATING A RAMP SIGNAL BETWEEN TWO TEMPERATURE POINTS OF OPERATION

FIELD OF THE INVENTION

The present invention relates to electronic circuits and, more particularly, to electronic circuits for sensing temperature.

BACKGROUND

In the electronics industry, there is a need for protecting circuits from conducting too much current. It is well understood that the power dissipated in a circuit is equal to current squared multiplied by resistance. Power dissipated in the circuit is directly proportional to heat generated. Therefore, one way of detecting the amount of current passing through a circuit component is by measuring the temperature of the component.

One solution for protecting circuits from conducting too much current is to place a temperature sensitive current limiter in series with the circuit. One such current limiter commonly used is built on a discrete component and employs a polymer sandwiched between two copper plates. Current passing through the limiter heats the polymer and causes it to expand. This expansion leads to a greater resistance which leads to even more heat being generated. In a relatively small current swing, the resistance of the polymer goes from a low value (approximately 50 mΩ) to a large value (much greater than 1 kΩ). This effectively creates an open in the discrete component and limits power to the circuit to be protected. After the temperature in the current limiter has decreased, the polymer contracts and the resistance decreases to the mΩ range again.

There are several disadvantages to this device for limiting current. First, the current limiter is built using discrete components and is not integratable onto an integrated circuit chip. Second, the size of the discrete component is about 10 times that of an integrated circuit package. Third, the initial resistance of this device increases with use.

SUMMARY

In accordance with the present invention, there is provided an apparatus for generating a ramp signal between two temperature values. The apparatus can be constructed on an integrated circuit and does not have to be a discrete component. The ramp signal can then be used in many different configurations. In one aspect, the ramp signal is inputted into a power regulator that supplies power to a circuit that needs to be protected. As the signal decreases, the power regulator reduces the amount of power reaching the protected circuit. When the signal reaches its minimum value, power is limited to a selected amount to the protected circuit.

In another aspect, the ramp signal is inputted into logic which outputs a constant first signal until a first temperature is detected and then outputs a constant second signal until a second temperature lower than the first temperature is detected. When the second temperature is detected, the ramp signal causes the logic to output the constant first signal again until the first temperature is detected. Such a configuration could, for example, be used to control a climate control module.

In another aspect, the invention provides for the various parameters of the ramp signal to be varied. For example, the apparatus can be readily modified to cause the ramp signal to occur between different pairs of temperature values to suit a particular application. The slope of the ramp signal can be modified to accommodate applications which require a faster or slower signal transition. If, for example, a circuit was more sensitive to heat generated from excess current, the ramp signal could be modified to quickly move to limit power to the circuit. With the appropriate powering source, the minimum and maximum values between which the signal goes can also be varied to suit a particular application's requirements.

Because the invention can reside on the same integrated circuit as the circuit it is protecting from excess power, the temperature controlled current sources feeding the apparatus can be tightly coupled to the temperature of sensitive components on the integrated circuit and easily connected to the apparatus. This reduces costs in building electronic devices while increasing performance in detecting temperature changes and eliminating excess current problems.

DETAILED DESCRIPTION

Figure 1:
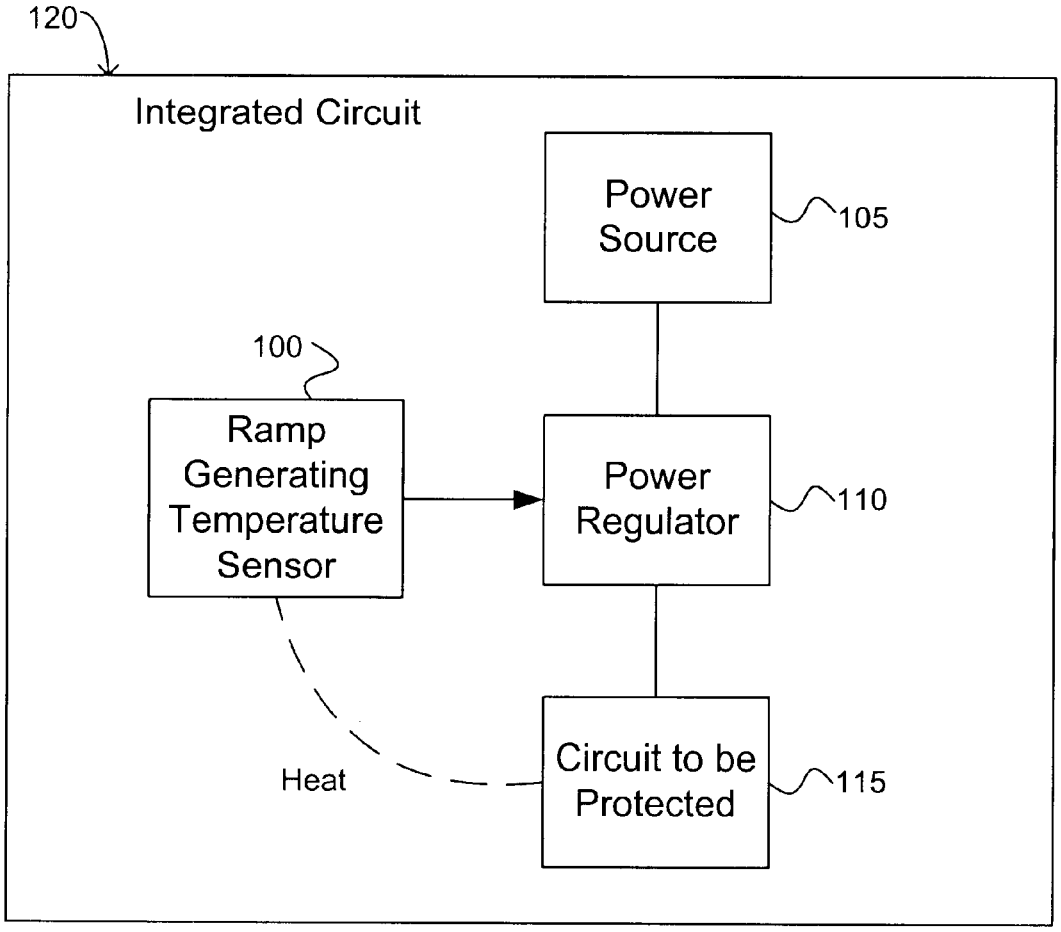
FIG. 1 is a simplified functional block diagram of a temperature sensor which generates a ramp signal for controlling a power regulator to protect another circuit according to one embodiment of the present invention.

FIG. 1 is a simplified functional block diagram illustrating a temperature sensor 100 responsive to heat generated by circuit 115 (herein also referred to as the circuit to be protected), temperature sensor 100 generating a ramp signal controlling a power regulator 110 to protect circuit 115 from heat by reducing power from power source 105, according to one embodiment of the invention. As used in this disclosure, ramp includes both linear and non-linear increasing and decreasing curves.

One embodiment of temperature sensor 100 contains several components (e.g., see FIG. 2) which are structured to generate a signal that varies with temperature (e.g., see FIG. 3) to operate the power regulator 110. In this embodiment, the invention contemplates using the temperature sensor 100 to operate the power regulator 110 such that as the temperature of the circuit to be protected 115 rises, the temperature sensor 100 detects the heat causing the temperature rise and sends a ramped signal that causes the power regulator 110 to reduce the power delivered to the circuit to be protected in proportion to the ramp signal received.

The temperature sensor 100, the power regulator 110, the protected circuit 115, and the power source 105 are all one integrated circuit 120, according to this embodiment of the present invention. In light of this disclosure, it will be recognized by those skilled in the art, however, that alternate embodiments of the present invention would have some or all of the elements listed above placed on different or the same integrated circuits and then connected together in a form similar to integrated circuit 120.

Figure 2:
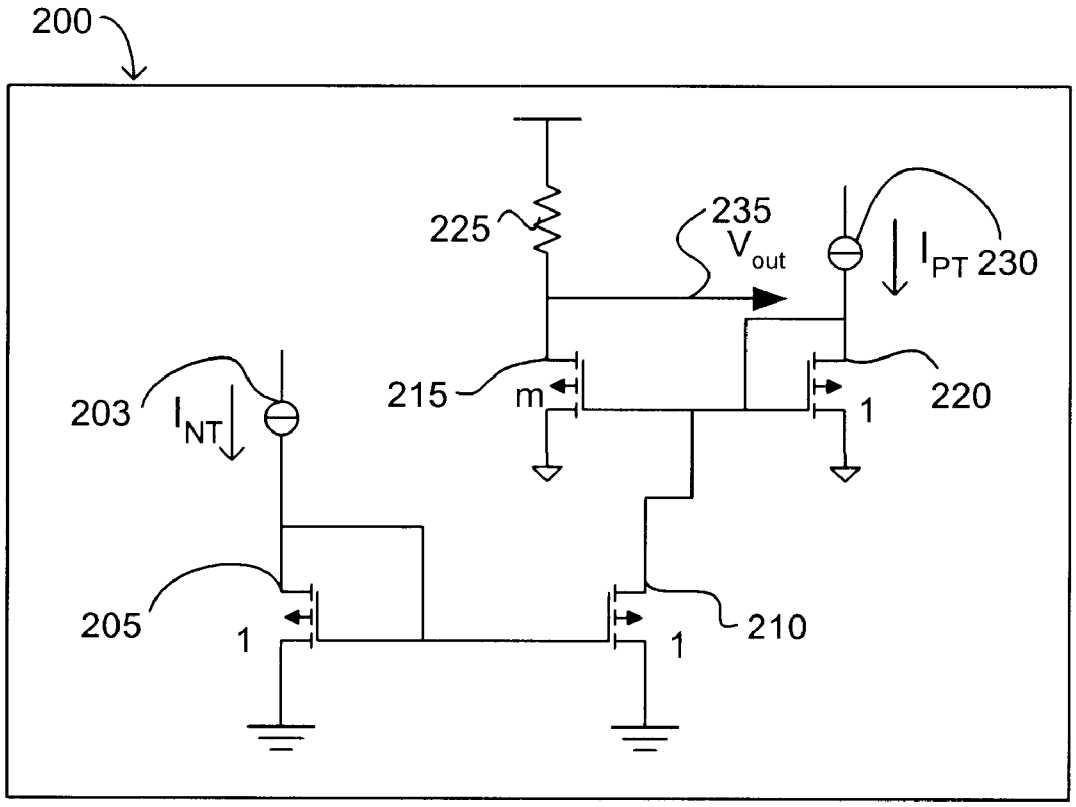
FIG. 2 is a circuit diagram of the temperature sensor of FIG. 1, according to one embodiment of the present invention.

FIG. 2 shows circuit 200 implementing the temperature sensor of FIG. 1, according to one embodiment of the invention. The circuit includes current sources 203 and 230, transistors 205, 210, 215, and 220, and a signal converter 225. In the figure, the signal converter is modeled as a resistor and converts current to voltage, but it will be recognized by those skilled in the art that other devices could be substituted to perform a signal conversion.

The elements of circuit 200 are interconnected as follows. Current source 203 is connected to the drain and gate of transistor 205. The source of transistor 205 is connected to receive a first voltage level, while its gate is connected to the gate of transistor 210. The source of transistor 210 is connected to receive the first voltage level. The drain of transistor 210 is connected to the gates of transistors 215 and 220, to current source 230, and to the drain of transistor 220. The sources of transistors 215 and 220 are connected to receive a second voltage level. The drain of transistor 215 connected to one terminal of signal converter 225 and to signal out terminal 235. The second terminal of signal converter 225 is connected to receive a third voltage level.

Figure 4:
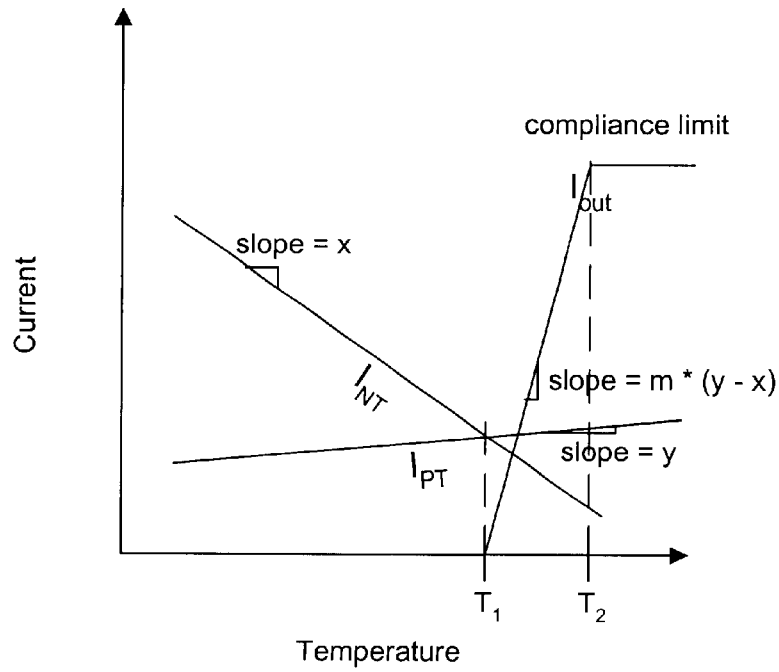
FIG. 4 is a graph showing currents for various elements of the circuit in FIG. 2, according to one embodiment of the invention.

In circuit 200, current sources 203 and 230 are constructed to vary their output currents with temperature. Current source 203 can be constructed, for example, such that as the temperature of the integrated circuit increases, the current generated decreases. Current source 230 can be constructed, for example, such that as the temperature of the integrated circuit increases, the current generated increases. This is shown in FIG. 4 where the current from current source 203 is labeled $I_{NT}$ and the current from current source 230 is labeled $I_{PT}$.

In FIG. 2, the current from one of the current sources (current source 230) increases with an increase in temperature while the current from the other current source (current source 203) decreases with an increase in temperature. In other embodiments of the invention, both current sources may generate currents which increase with an increase in temperature or both may generate currents which decrease with an increase in temperature. In another embodiment, current source 203 generates a current which increases with an increase in temperature and current source 230 generates a current which decreases with an increase of temperature. Both current sources, however, cannot output currents which increase and decrease at the same rate over all temperature values. In other words, current source 203 cannot output a current which is simply the same as the output from current source 230 plus a constant over all temperature values. Thus, the embodiments of the invention include all combinations of increasing and decreasing current sources 203 and 230, except the exception mentioned above.

Typically, current sources 203 and 230 would be integrated onto the same chip as the circuit needing current limiting protection. This integration would provide tight thermal coupling of the current sources to the circuit to be protected. As is known in the art, the current sources could be constructed such that each had a different starting value and a different current slope as shown in FIG. 4. The current sources, however, are not constrained to be on the same chip as the circuit needing current limiting protection and could be any other circuitry capable of generating current.

Continuing with FIG. 2, it will be recognized by those skilled in the art that transistors 205 and 210 are configured in a current/mirror configuration with the current on transistor 210 mirroring that on transistor 205. Transistors 215 and 220 are also configured in a current/mirror configuration with the current on transistor 215 mirroring that on transistor 220 minus the drain current of transistor 210. Because of device sizes, however, transistor 215 is constructed to mirror a multiple of the current on transistor 220. In the figure, this multiple is depicted by the variable m.

Figure 3:
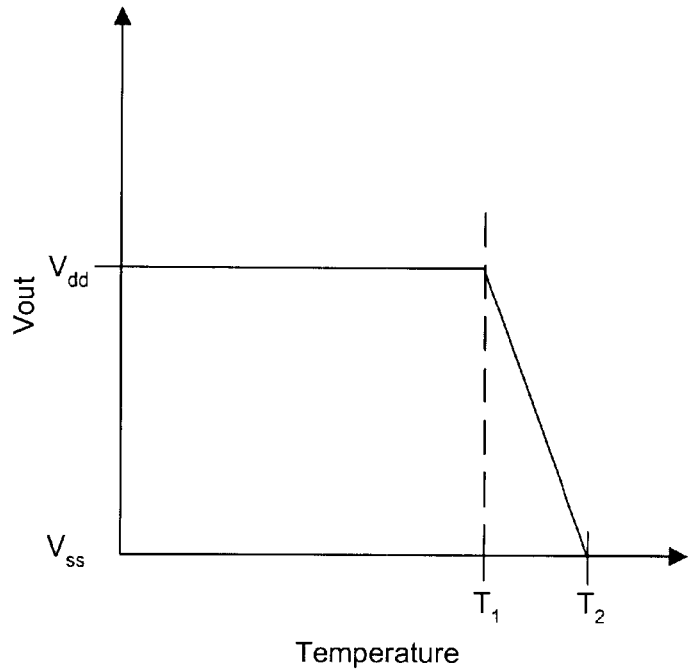
FIG. 3 is a graph showing how the signal of the circuit in FIG. 2 varies as a function of temperature, according to one embodiment of the invention.

In one embodiment of the invention, the interaction of the current mirrors creates the signal output of FIG. 3. Because transistor 210 is configured to mirror the current of current source 203, this has the effect of diverting current from current source 230. When current source 230 outputs less current than current source 203, this causes transistor 220 to be turned off. Turning transistor 220 off also turns off its mirroring transistor 215. Since no current is flowing through resistor 225, this causes the signal level at $V_{out}$ terminal 235 to be $V_{dd}$.

As the current provided by current source 230 increases above that provided by current source 203, this difference is mirrored and multiplied by m on transistor 215. This current through resistor 225 lowers the signal level at $V_{out}$ terminal 235 as current provided by current source 230 increases until $V_{ss}$ is reached. This is shown in FIG. 3.

In view of this disclosure, it will be recognized by those skilled in the art that resistor 225 is simply a signal converter. As current increases through the resistor, voltage across the resistor increases and the signal level at $V_{out}$ terminal 235 decreases relative to $V_{ss}$. It will be recognized by those skilled in the art that other electronic devices, both passive and active, could be used to convert signals and provide an output signal on $V_{out}$ terminal 235. Such equivalents could be used in alternate embodiments of this invention.

It will also be recognized by those skilled in the art that the gradual ramp decrease in the signal level at $V_{out}$ terminal 235 could be used to drive a gate or other logic to vary power to a circuit needing current protection (not shown).

Having a ramp signal as shown in FIG. 3 instead of a step function is advantageous. It avoids, for example, step discontinuity which could cause oscillation in systems such as a thermostat control. If the thermostat was set to maintain a temperature of 75 degrees and a step function was used to turn on a heater or an air conditioner, once the temperature got close to 75 degrees, the thermostat could quickly vary between turning on the heater and turning on the air-conditioning unit. With the gradual ramp signal described above, the thermostat could slowly decrease the cooling or heating when close to the specified temperature and avoid unneeded oscillations.

The ramp signal also avoids thermal instability in an integrated circuit that includes the invention. For example in FIG. 1, the temperature sensor 100 senses the heat of the circuit to be protected 115. In one embodiment of the invention, when the temperature sensed increases over a threshold value, the temperature sensor 100 sends a signal to the power regulator 110 as shown in FIG. 3. The power regulator responds to the signal by gradually turning off power to the circuit to be protected 115. As the power to the circuit to be protected 115 decreases, less heat is generated. The slow ramp feedback provided through this thermal feedback loop has the effect of reducing the gain of the system and increasing stability.

FIGS. 3 and 4 show the operation of circuit 200 of FIG. 2. As seen in FIG. 4, as temperature increases, eventually, $I_{PT}$ increases over that of $I_{NT}$. This occurs at a temperature $T_1$. The value of temperature $T_1$ and the crossing value and slopes of $I_{PT}$ and $I_{NT}$, e.g. x and y as shown in FIG. 4, can be adjusted by changing the device characteristics for the current sources supplying $I_{NT}$ and $I_{PT}$. When $I_{PT}$ increases over that of $I_{NT}$, the difference is multiplied by m and passes through resistor 225 of FIG. 2. By modifying m, one can change the slope of the current passing through the resistor according to the equation of the slope for $I_{out}$, i.e. m*(y−x), as shown in FIG. 4. This could, for example, be used to lengthen or shorten the temperature difference for the swing from the high signal depicted as $V_{dd}$ in FIG. 3 and the low signal depicted as $V_{ss}$ in FIG. 3.

Having transistor 215 mirror m times the amount of current passing through transistor 220 has additional advantages. An appropriate choice of m, for example, allows a full voltage swing at $V_{out}$ terminal 235 with only a reasonably small resistor being used for resistor 225. This saves chip real estate that would be required for a larger resistor. An appropriate choice of m also allows current sources 203 and 230 to be chosen to generate an arbitrarily small amount of current because m can be chosen to multiply the difference in current generated by current sources 203 and 230 sufficient to cause resistor 225 to generate a fall voltage swing output on terminal 235. The effect of choosing small currents for current sources 203 and 230 is that less power is consumed by the circuit while the temperature is below a threshold value.

As the temperature increases from $T_1$ to $T_2$ in FIG. 4, the current through resistor 225 of FIG. 2 continues to increase until the compliance limit shown in FIG. 4 is reached. This compliance limit corresponds to where $V_{out}$ reaches $V_{ss}$ as shown in FIG. 3.

The circuit shown in FIG. 2 is constructed using n-channel field effect transistors (FETS). It will be recognized by those of ordinary skill in the art that this circuit could also be constructed using p-channel FETS or pnp or npn bipolar transistors or some combination of FETS and bipolar transistors.

Furthermore, while some of the FETS in FIG. 2 have their sources connected to ground, it will also be recognized by those skilled in the art that these sources could be connected to a common voltage level other than ground or could be coupled through resistive networks to a common voltage level without departing from the spirit of this invention.

Figure 5:
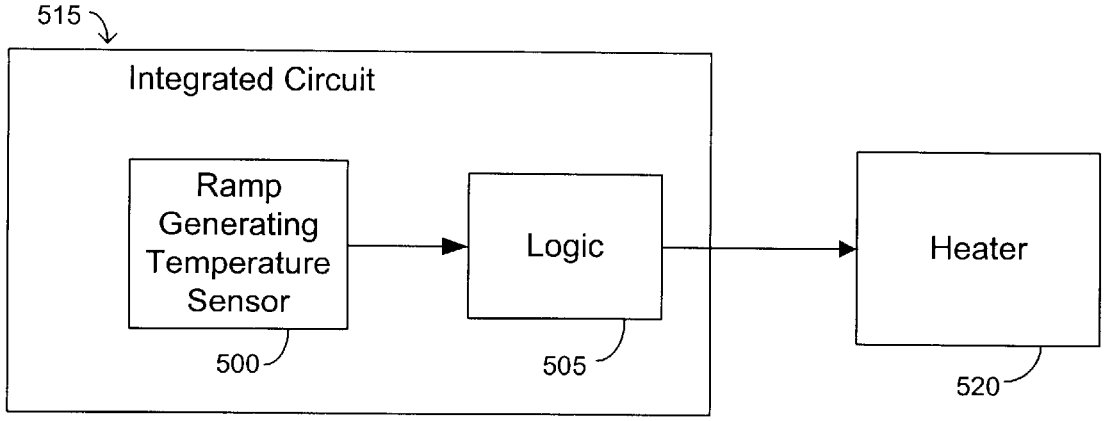
FIG. 5 is a simplified functional block diagram of a temperature sensor which generates a ramp signal to drive logic which activates and deactivates a heating element, according to another embodiment of the invention.

FIG. 5 is a simplified functional block diagram illustrating a temperature sensor 500 generating a ramp signal driving logic 505 which activates and deactivates a heating element 520, according to another embodiment of the present invention. Temperature sensor 500 is constructed and operates as temperature sensor 100 as previously discussed in conjunction with FIG. 1. The ramp signal from the temperature sensor 500 is inputted into logic 505 which generates control signals for driving heater 520.

In this embodiment, temperature sensor 500 and logic circuit 505 are shown residing on integrated circuit 515. In other embodiments, however, these modules could be placed on different integrated circuits and then connected together in a form similar to circuit 515.

Figure 6:
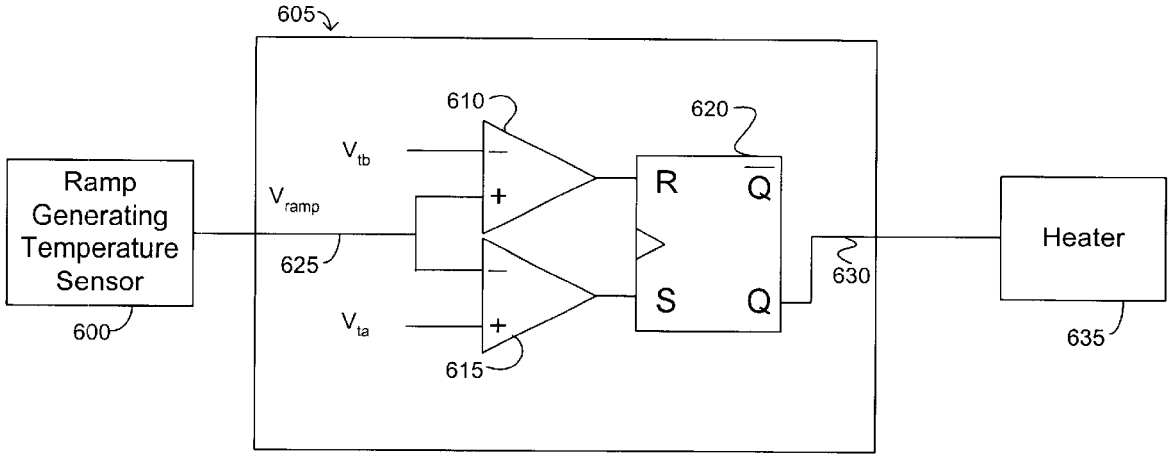
FIG. 6 is a circuit diagram illustrating one embodiment of the logic block of FIG. 5 that drives the heating element.

FIG. 6 shows circuit 605 implementing one embodiment of the logic 505 of FIG. 5 as well as blocks representing inputs to and output from this circuit. The input block is temperature sensor 600 while the output block is heater 635. Circuit 605 includes input terminal 625, output terminal 630, comparators 610 and 615, SR flip-flop 620, and voltages $V_{tb}$ and $V_{ta}$.

The elements of circuit 605 are connected as follows. One of the inputs for comparator 610 is connected to one input for comparator 615 and to input terminal 625. Input terminal 625 is also connected to temperature sensor 600. The other input for comparator 610 is connected to receive voltage level $V_{tb}$ while the other input for comparator 615 is connected to receive voltage level $V_{ta}$. The output of comparator 610 is connected to the R input of SR flip-flop 620, and the output of comparator 615 is connected to the S input of SR flip-flop 620. Flip-flop 620 output Q is connected to output terminal 630 which connects to heater 635.

Figure 7:
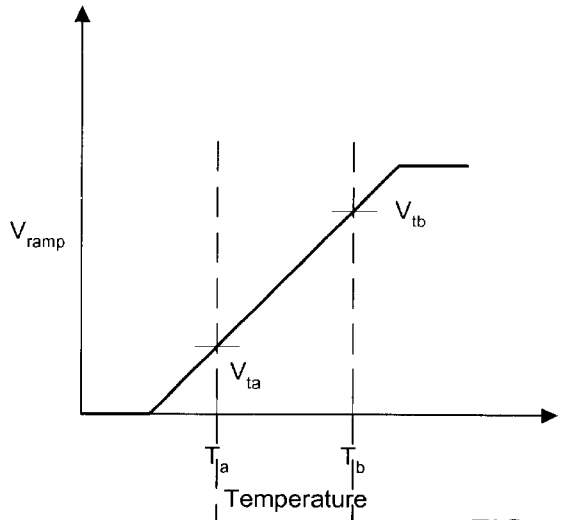
FIG. 7 is a graph showing a ramp signal output between two temperature values, according to one embodiment of the invention.
Figure 8:
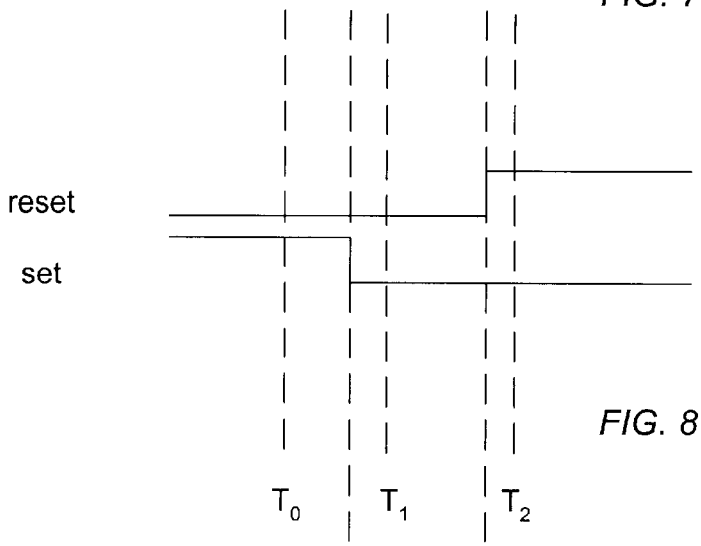
FIG. 8 is a timing diagram illustrating the logic response of FIG. 6 to the ramp signal of FIG. 7, according to one embodiment of the invention.
Figure 9:
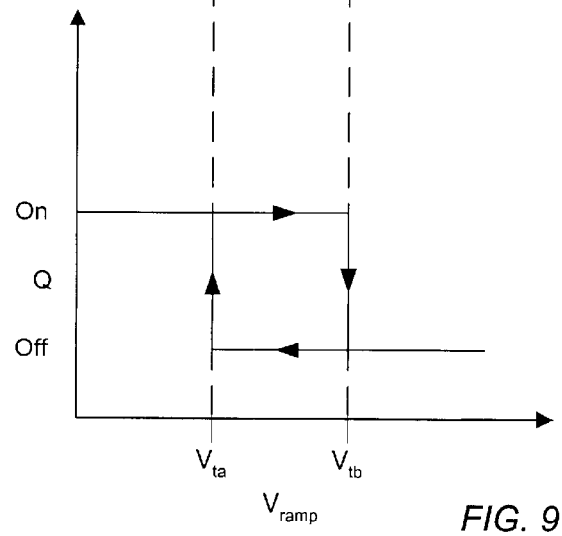
FIG. 9 is a graph illustrating how the output from the logic in FIG. 6 hysteretically varies as the ramp signal output of FIG. 7 changes, according to one embodiment of the invention.

According to one embodiment of the present invention, circuit 605 operates as shown in FIGS. 7, 8, and 9. While the voltage ($V_{ramp}$) on input terminal 625 is below $V_{ta}$ (e.g., at temperature $T_0$), comparator 615 asserts a high value on the set input and comparator 610 asserts a low value on the set input of SR flip-flop 620. This causes the output Q of SR flip-flop 620 to be high at voltages below $V_{ta}$. * When $V_{ramp}$ is greater than or equal to $V_{ta}$ (e.g., at Temperature $T_1$), comparator 615 asserts a low value on the set input of SR flip-flop 620. When $V_{ramp}$ is greater than or equal to $V_{tb}$ (e.g., at temperature $T_2$), comparator 610 asserts a high value on the reset input of SR flip-flop 620. This causes the output Q of SR flip-flop 620 to be low at voltages above $V_{tb}$.

In between voltages $V_{ta}$ and $V_{tb}$, the output Q of SR flip-flop 620 follows the waveform shown in FIG. 9. Specifically, as $V_{ramp}$ increases to $V_{ta}$ and then from $V_{ta}$ to $V_{tb}$, Q maintains a high level. When $V_{ramp}$ increases to or over $V_{tb}$, Q falls to a low level. Q, then, remains as this low level until $V_{ramp}$ decreases to or lower than $V_{ta}$.

This behavior of logic 605 has desirable characteristics for driving a heater. Instead of continually turning the heater on and off as a temperature reaches a certain value, logic 605 causes the heater to remain on until an upper threshold is reached. Then, logic 605 causes the heater to remain off until a lower threshold is reached. This has the effect of eliminating continual oscillations that could occur when a desired temperature is reached with an apparatus structured to turn the heater on below the desired temperature and off when above the desired temperature.

Furthermore, use of logic 605 also eliminates the need to use two temperature sensors and a memory device as found in other climate control units.

In view of the present disclosure, those skilled in the art can implement other embodiments using other logic to take the place of circuit 605 to control heater 630. Such logic could range from simple logic gates to complex microprocessor design and is within the scope of this invention.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A circuit for controlling power from a power source to a second circuit dependent on a temperature, the circuit comprising:

(a) a temperature sensor including a first current source and a second current source, wherein the temperature sensor is configured to combine the current sources' outputs to generate an output signal, wherein the output signal is ramped when the temperature is in a temperature range defined between a first temperature and a second temperature, and wherein the output signal is non-ramped when the temperature is outside the temperature range; and (b) a control element coupled to the temperature sensor, the power source, and the second circuit wherein the control element is configured to vary power delivered from the power source to the second circuit responsive to the output signal.

2. The circuit of claim 1 wherein when the output signal is ramped, the output signal corresponds to a difference between the current sources' outputs.

3. The circuit of claim 2, wherein when the output signal is non-ramped, the output signal is substantially constant.

4. The circuit of claim 1 wherein the temperature sensor, the power source, the control element, and the second circuit are all contained on a single monolithic integrated circuit.

5. The circuit of claim 1 wherein the control element comprises a transistor configured to receive the ramped output signal on the transistor's control terminal and vary current delivered to the second circuit responsive to the ramped output signal.

6. The circuit of claim 4 wherein the control element comprises a microprocessor.

7. The circuit of claim 4 wherein the control element is configured to generate a high output value when the output signal is below a threshold value and a low output value when the output signal is above the threshold value.

8. The circuit of claim 7, further comprising a climate control unit coupled to the control element, the climate control unit being structured to receive input from the control element and to cool or heat accordingly.

9. The circuit of claim 4 wherein the first temperature and the second temperature of the temperature range are selectable.

10. The circuit of claim 4 wherein the ramped output signal is configurable as to its maximum and minimum signal levels.

11. The circuit of claim 4 wherein the temperature sensor senses temperature on the second circuit by being placed in close proximity to the second circuit.

12. A circuit configured to generate a ramp signal between first and second temperatures, the circuit comprising:

(a) a first transistor with a first terminal and a control terminal directly connected to a first current source, and a second terminal directly connected to receive a first voltage level;

(b) a second transistor, including a first, a second, and a control terminal, wherein the control terminal of the second transistor is directly connected to the control terminal of the first transistor, and the first terminal of the second transistor is directly connected to receive the first voltage level such that the second transistor mirrors a current passing through the first transistor;

(c) a third transistor with a first terminal and a control terminal directly connected to a second current source and to the second terminal of the second transistor, and a second terminal directly connected to receive the first voltage level;

(d) a fourth transistor with a first terminal directly connected to a signal converter, a control terminal directly connected to the first terminal of the third transistor, and a second terminal directly connected to receive the first voltage level such that the fourth transistor mirrors a multiple of the current passing through the third transistor; and (e) the signal converter with a first end directly connected to the first terminal of the fourth transistor and its second end directly connected to receive a second voltage level.

13. The circuit of claim 12 wherein at least one of the transistors is a field effect transistor.

14. The circuit of claim 13 wherein at least one of the transistors is an n-channel device.

15. The circuit of claim 12 wherein the current sources are temperature controlled.

16. The circuit of claim 12 wherein the signal converter comprises a resistor.

17. The circuit of claim 12 wherein the voltage at the first terminal of the third transistor is used to control current provided to another circuit.

18. A first circuit for controlling power from a power source to a second circuit dependent on a temperature, the first circuit comprising:

(a) means for sensing temperature and generating an output signal, wherein the output signal is ramped when the temperature is in a temperature range defined between a first temperature and a second temperature, and wherein the output signal is non-ramped when the temperature is outside the temperature range, and wherein the means for sensing temperature includes first and second current sources; and (b) means for varying power delivered from the power source to the second circuit responsive to the output signal.

19. The first circuit of claim 18 wherein when the output signal is ramped, the output signal corresponds to a difference between the current sources' outputs.

20. The first circuit of claim 18 wherein the first circuit and the second circuit are on different discrete components.

* * * * *